US010609954B2

(12) United States Patent
Fallon

(10) Patent No.: US 10,609,954 B2
(45) Date of Patent: Apr. 7, 2020

(54) METHOD OF FABRICATING A FILTER ELEMENT

(71) Applicant: British American Tobacco (Investments) Limited, London (GB)

(72) Inventor: Gary Fallon, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 291 days.

(21) Appl. No.: 14/900,226

(22) PCT Filed: Jun. 20, 2014

(86) PCT No.: PCT/GB2014/051904
§ 371 (c)(1),
(2) Date: Dec. 21, 2015

(87) PCT Pub. No.: WO2014/203003
PCT Pub. Date: Dec. 24, 2014

(65) Prior Publication Data

US 2016/0143349 A1 May 26, 2016

(30) Foreign Application Priority Data

Jun. 21, 2013 (GB) ..... 1311079.6

(51) Int. Cl.
*A24D 3/04* (2006.01)
*D21H 27/40* (2006.01)
(Continued)

(52) U.S. Cl.
CPC ..... *A24D 3/0287* (2013.01); *A24D 1/02* (2013.01); *A24D 3/025* (2013.01); *A24D 3/04* (2013.01); *A24D 3/043* (2013.01); *D21H 27/40* (2013.01)

(58) Field of Classification Search
CPC ..... A24D 3/0287; A24D 1/02
(Continued)

(56) References Cited

U.S. PATENT DOCUMENTS 1,186,998 A * 6/1916 Langston ..... B31F 1/2877 156/472
2,035,398 A 10/1934 Muller
(Continued)

FOREIGN PATENT DOCUMENTS

DE 3225068 A1 1/1983
EP 0160380 A1 11/1985
(Continued)

OTHER PUBLICATIONS https://www.merriam-webster.com/dictionary/laminate (Year: 2018).*
(Continued)

*Primary Examiner* — Eric Yaary
*Assistant Examiner* — Russell E Sparks
(74) *Attorney, Agent, or Firm* — Cantor Colburn LLP

(57) ABSTRACT

A method of fabricating a smoking article filter element includes arranging a corrugated laminate web around a portion of filter material having an elongate shape and a longitudinal axis, such that the grooves and ridges of the laminate web run in the same direction as the longitudinal axis of the filter material. A method of fabricating a smoking article involves the same method as that of fabricating a smoking article filter element.

14 Claims, 5 Drawing Sheets

(51) Int. Cl.
*A24D 3/02* (2006.01)
*A24D 1/02* (2006.01)

(58) Field of Classification Search
USPC ..... 131/280
See application file for complete search history.

(56) References Cited

U.S. PATENT DOCUMENTS

| | | | | | |
|---|---|---|---|---|---|
| 2,639,660 | A * | 5/1953 | Sunderhauf | B21H 8/005 | 101/23 |
| 3,596,663 | A | 8/1971 | Schultz | | |
| 4,481,959 | A | 11/1984 | Byrne | | |
| 4,492,240 | A * | 1/1985 | Hayes | A24D 3/043 | 131/336 |
| 4,546,965 | A | 10/1985 | Baxter | | |
| 4,570,649 | A * | 2/1986 | Nichols | A24D 3/041 | 131/336 |
| 4,575,368 | A * | 3/1986 | Sagawa | A24D 3/0233 | 131/37 |
| 4,582,071 | A * | 4/1986 | Westcott | A24D 3/043 | 131/336 |
| 4,637,409 | A | 1/1987 | Berger | | |
| 4,898,190 | A * | 2/1990 | Deal | A24D 3/041 | 131/198.2 |
| 6,209,547 | B1 * | 4/2001 | Koller | A24B 15/282 | 131/331 |
| 6,718,989 | B1 | 4/2004 | Clarke | | |
| 9,561,929 | B2 * | 2/2017 | Mellin | B31C 1/00 | |
| 2006/0144915 | A1 * | 7/2006 | Sadlier | B65D 3/22 | 229/403 |

FOREIGN PATENT DOCUMENTS

| | | | |
|---|---|---|---|
| EP | 0352106 | A2 | 1/1990 |
| GB | 2102271 | A | 2/1983 |
| GB | 2119221 | A | 11/1983 |
| GB | 2136669 | A | 9/1984 |
| WO | 9702378 | A1 | 1/1997 |
| WO | 9916534 | A1 | 4/1999 |
| WO | 2008056099 | A1 | 5/2008 |
| WO | 2009037304 | A1 | 3/2009 |
| WO | 2013024263 | A1 | 2/2013 |

OTHER PUBLICATIONS

Definition of Laminate, Merriam-Webster Dictionary, https://www.merriam-webster.com/dictionary/laminate (Year: 2019).*
International Search Report for corresponding application PCT/GB2014/051904 filed Jun. 20, 2014; dated Sep. 23, 2014.
Written Opinion for corresponding application PCT/GB2014/051904 filed Jun. 20, 2014; dated Sep. 23, 2014.

* cited by examiner

METHOD OF FABRICATING A FILTER ELEMENT

FIELD OF THE INVENTION

The present invention relates to methods of fabricating smoking article filter elements and smoking articles.

SUMMARY

According to a first aspect, there is provided a method of fabricating a filter element for use in a smoking article comprising:

providing a portion of filter material having an elongate shape and a longitudinal axis;

providing a corrugated laminate web having grooves and ridges on one face of the laminate web, the laminate web comprising a corrugated first web and a non-corrugated second web; and arranging the corrugated laminate web around the filter material such that the grooves and ridges of the corrugated laminate web run in the same direction as the longitudinal axis of the filter material.

In some embodiments, the method of the invention further comprises a step of preparing the corrugated laminate web, said step comprising providing a corrugated first web and a non-corrugated second web and arranging the corrugated first web and the non-corrugated second web to form a corrugated laminate web.

In some embodiments, the step of preparing the corrugated laminate web and the step of arranging the corrugated laminate web around the filter material are part of a continuous process.

In some embodiments, the method of the invention further comprises a step of storing the corrugated laminate web before the step of arranging the corrugated laminate web around the filter material.

In some embodiments, the corrugated first web comprises cellulose acetate.

In some embodiments, the non-corrugated second web comprises semi crepe paper.

In some embodiments, the corrugated first web is bonded to the non-corrugated second web. For example, the corrugated first web is bonded to the non-corrugated second web by adhesive.

In some embodiments, the corrugated laminate web is arranged around the filter material so that the face of the corrugated laminate web having no ridges and no grooves is facing the filter material. As a result, the face of the corrugated laminate web having grooves and ridges is outward facing, i.e. it faces away from the filter material. Such an arrangement allows the corrugated laminate web to interact with an additional layer of material arranged around it, such as a layer of material having pawls designed to rotate between different positions, and be held in different positions by virtue of the pawls and the corrugations.

In some embodiments, the method of the invention further comprises arranging one or more additional layers of material around the corrugated laminate web.

For example, the additional layer of material comprises an indexing surface capable of indexing with the grooves and ridges of the corrugated laminate web.

In some embodiments, the corrugated laminate web may be arranged around the filter material, wherein the filter material is cylindrically shaped having a longitudinal axis, and the corrugated laminate web is arranged so as to completely cover the curved surface of the cylindrically shaped filter material.

In some embodiments, the corrugated first web and the non-corrugated second web are the same size and shape, and arranged to provide a laminate in which there are no regions where the corrugated first web does not overlap with the non-corrugated second web.

In some embodiments, the method of the invention further comprises a step of preparing the corrugated first web, which comprises corrugating a flat web to provide said corrugated first web.

According to a second aspect, there is provided a method of fabricating a smoking article, wherein the method comprises preparing a smoking article filter element according to any method of the first aspect before or after connecting the filter material to a rod of tobacco material.

According to a third aspect, there is provided a filter element for use in a smoking article obtained by/obtainable by any method according to the first aspect of the invention.

According to a fourth aspect, there is provided a smoking article obtained by/obtainable by any method according to the second aspect of the invention.

According to a fifth aspect, there is provided an apparatus for fabricating a filter element according to the first aspect, or fabricating a smoking article according to the second aspect.

BRIEF DESCRIPTION OF THE DRAWINGS

Embodiments will now be described, by way of example only, with reference to the accompanying drawings (not to scale), in which.

DETAILED DESCRIPTION

Figure 1:
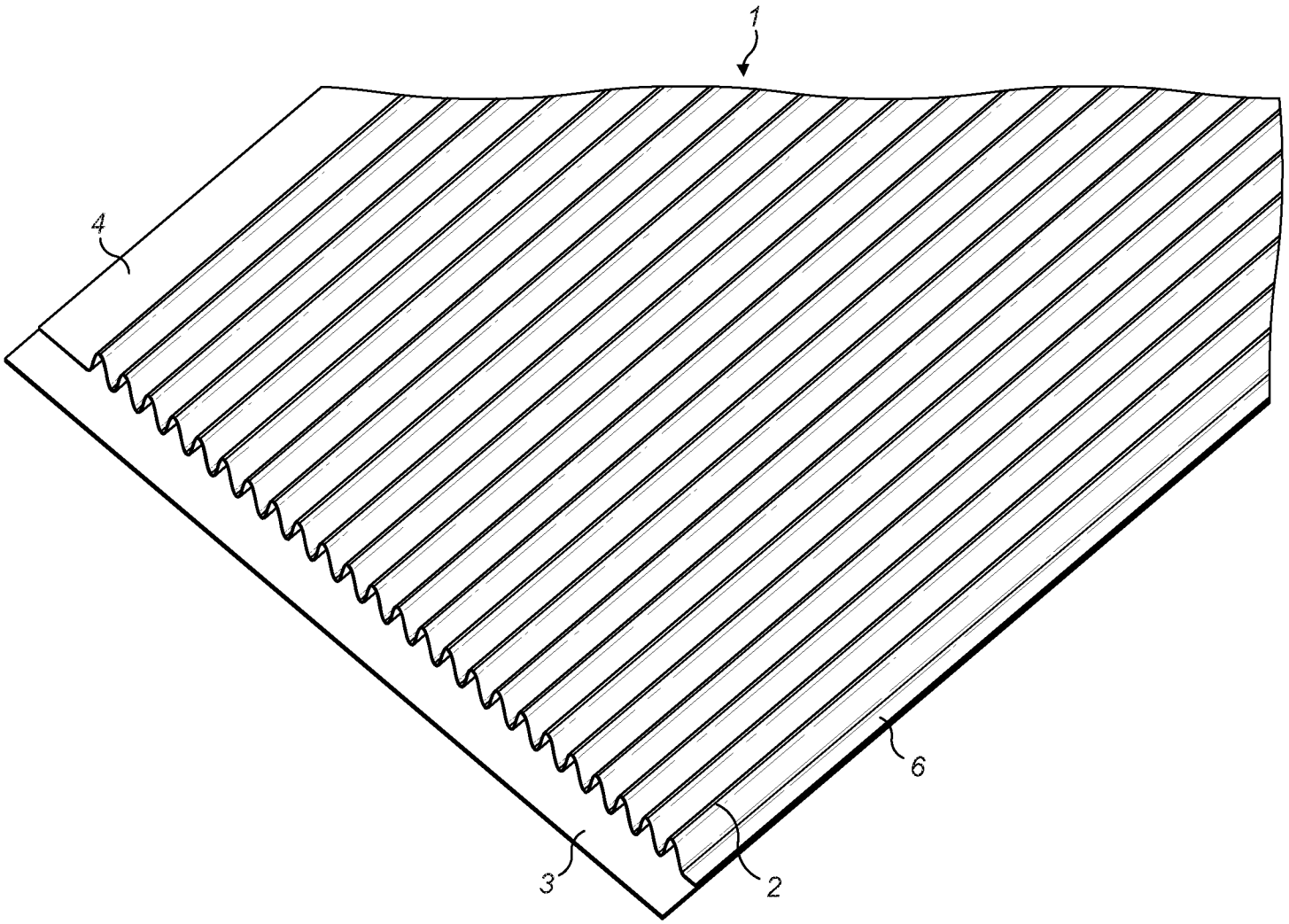
FIG. 1 shows the structure of a corrugated laminate web employable in some embodiments of the method of the invention.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

The present invention relates to a method of fabricating a filter element for use in a smoking article, wherein the method comprises arranging a pre-prepared corrugated laminate web around a portion of filter material.

The method of the invention comprises one or more suitable steps for arranging the corrugated laminate web around a portion of filter material.

In some embodiments, the corrugated laminate web is arranged around the filter material so that the face of the corrugated laminate web having no ridges and no grooves is facing the filter material. As a result, the face of the corrugated laminate web having grooves and ridges is outward facing, i.e. it faces away from the filter material.

The corrugated laminate web may be arranged around the filter material so as to cover completely the surface of the filter material. Alternatively, the corrugated laminate web may be arranged around the filter material so as to cover a part of the surface of the filter material.

In some embodiments, the corrugated laminate web may be arranged around the filter material, wherein the filter material is cylindrically shaped having a longitudinal axis, and the corrugated laminate web is arranged so as to completely cover the curved surface of the cylindrically shaped filter material. For example, the grooves and ridges of the corrugated laminate web may run parallel with the longitudinal axis of the filter material.

The corrugated laminate web may be any suitable size and shape. In some embodiments, the corrugated laminate web has a rectangular shape or similar.

In some embodiments, the corrugated laminate web is reduced in size before being arranged around the filter material. The corrugated laminate web may be reduced in size using any suitable process or processes, such as those which comprise the use of any suitable cutting apparatus.

In some embodiments, the corrugated laminate web is applied as a continuous feed, wherein the continuous feed of corrugated laminate web may be reduced to the desired size, for example by cutting. In such embodiments, the grooves and ridges of the corrugated laminate web run laterally to the direction of travel of the continuous feed.

The corrugated laminate web comprises a corrugated first web and a non-corrugated second web.

The corrugated first web and the non-corrugated second web may comprise one or more suitable materials, and may comprise the same or different material compositions.

The corrugated first web and the non-corrugated second web may have any suitable size and shape before and after being arranged to provide a laminate and may have the same or different size and/or shape before and/or after being arranged to provide a laminate. In some embodiments, the two webs are substantially the same size and shape, and arranged to provide a laminate in which the two webs overlap so that there are no regions where the first web is not covered by the second web, and vice versa.

The corrugated first web may comprise one or more suitable materials. In some embodiments, the corrugated first web comprises one or more materials which form a sufficiently rigid material for making and maintaining a corrugated structure.

In some embodiments, the corrugated first web comprises cellulose acetate or any suitable derivative thereof. In these embodiments, the layer of cellulose acetate or any suitable derivative thereof may be obtained from a tow of cellulose acetate or any suitable derivative thereof. This may be achieved by treating the tow with at least one of steam, thermal energy, and pressure, before feeding the tow through an aperture of any suitable dimensions.

One example of a suitable corrugated first web comprising cellulose acetate is a film of CLARIFOIL® cellulose diacetate film manufactured by THE CELANESE CORPORATION. This material has been found to form sufficiently stable corrugations for incorporation into a smoking article filter element and smoking article.

Another example of a suitable corrugated first web comprising cellulose acetate is a film of NATUREFLEX™ compostable and renewable packaging film manufactured by INNOVIA FILMS, such as E190 28 micron NATUREFLEX™ compostable and renewable packaging film. This material has been found to form sufficiently stable corrugations for incorporation into a smoking article filter element and smoking article.

The material forming the corrugated first web may have any suitable thickness, and its thickness may be uniform or non-uniform. In some embodiments, the corrugated first web has a thickness equal to or more than 20 μm, 30 μm, 40 μm, 50 μm, 60 μm, 70 μm, 80 μm, 90 μm, or 100 μm.

In some embodiments, the material forming the corrugated first web has a uniform thickness of between about 30 μm and 70 μm.

In some embodiments, the material forming the corrugated first web has a uniform thickness of about 50 μm.

In some embodiments, the corrugated first web comprises a CLARIFOIL® cellulose diacetate film and/or a NATUREFLEX™ compostable and renewable packaging film and has a uniform thickness of between about 20 μm and 50 μm.

In some embodiments, the method of the invention further comprises a step of preparing the corrugated first web. For example, the corrugated first web may be prepared from a flat web. Such a preparation may involve corrugating a flat web to provide the corrugated first web. For example, a web may be passed between a pair of corrugation rollers.

One example of a suitable flat web comprising cellulose acetate is a film of CLARIFOIL® cellulose diacetate film manufactured by THE CELANESE CORPORATION. This material has been found to form sufficiently stable corrugations for incorporation into a smoking article filter element and smoking article.

Another example of a suitable flat web comprising cellulose acetate is a film of NATUREFLEX™ compostable and renewable packaging film manufactured by INNOVIA FILMS, such as E190 28 micron NATUREFLEX™ compostable and renewable packaging film. This material has been found to form sufficiently stable corrugations for incorporation into a smoking article filter element and smoking article.

The non-corrugated second web has no grooves and no ridges; it is substantially flat.

The non-corrugated second web may comprise one or more suitable materials, such as materials conventionally employed as smoking article plug wrap and/or tipping paper.

In some embodiments, the non-corrugated second web comprises any suitable paper material, such as semi crepe paper. The paper material may have any suitable paper density, such as a paper density of about 30 gsm or more. For example, the paper density may be about 30 gsm, 40 gsm, 50 gsm, 60 gsm, 70 gsm, 80 gsm, 90, gsm, 100 gsm, or more than 100 gsm.

In some embodiments, the non-corrugated second web comprises a semi crepe paper with a paper density of about 80 gsm.

In some embodiments, the non-corrugated second web comprises one or more substances for improving its rigidity. In embodiments wherein the non-corrugated second web comprises a paper material, suitable substances for improving rigidity include starch, a suitable adhesive such as PVA, and/or shellac.

The non-corrugated second web may have any suitable thickness, and its thickness may be uniform or non-uniform.

In some embodiments, the non-corrugated second web has a thickness equal to or more than 20 μm, 30 μm, 40 μm, 50 μm, 60 μm, 70 μm, 80 μm, 90 μm, 100 μm, or 110 μm.

In some embodiments, the non-corrugated second web has a uniform thickness of about 50 μm.

In some embodiments, the non-corrugated second web comprises a semi crepe paper with a paper density of about 80 gsm and has a uniform thickness of about 50 μm.

The method of the invention may further comprise one or more steps of cutting ventilation and/or perforation patterns into the non-corrugated second web.

Apparatus for cutting ventilation and/or perforation patterns into webs are conventional. In these embodiments, the second web may pass through this apparatus before, during, and/or after connecting to the corrugated first web.

This apparatus may cut patterns using a laser and, in this case, the apparatus may be referred to as a "laser cutting module".

In some embodiments, a laser cutting module may be used to cut a repeating pattern along the length of the non-corrugated second web.

In some embodiments, the method may further comprise one or more steps of cutting sections and/or windows out of the non-corrugated second web. Apparatus for this purpose is conventional. This apparatus may be referred to as a "crush cutter". In these embodiments, the non-corrugated second web may pass through one or more crush cutters before, during, and/or after connecting to the corrugated first web.

In some embodiments, the method may further comprise one or more steps for pin-pricking a pattern into the non-corrugated second web. In these embodiments, the second web may pass through one or more pin-prickers before, during, and/or after connecting to the corrugated first web.

In some embodiments, the method of the invention may further comprise one or more steps of embossing a pattern into the non-corrugated second web. Apparatus for embossing is conventional. This apparatus may comprise an embossing head for contacting and embossing a pattern into the second web, and the embossing head may be easy to integrate with any other apparatus used in the method of the invention.

The method of the invention may further comprise any suitable process or processes for preparing such a laminate, wherein the process or processes comprise arranging a first corrugated web and a second non-corrugated web to provide a corrugated laminate web having grooves and ridges on one of the faces.

The corrugated first web and the non-corrugated second web may be bonded together. For example, the corrugated first web and the non-corrugated second web may be bonded by adhesive.

Accordingly, the method of the invention may further comprise a step of bonding the corrugated first web to the non-corrugated second web, for example, using adhesive.

In some embodiments, the first and second webs are bonded to form a laminate in the method of the invention by one or more processes comprising the use of one or more suitable adhesive substances.

Examples of suitable adhesive substance are substances comprising a Hot-Melt Adhesive (HMA), such as NATIONAL hot melt adhesive 334-2950, and/or a PVA-based adhesive, such as NATIONAL hot melt adhesive 132-039A. Suitable cold melt adhesives could also be used.

One or more adhesive substances may be applied in any suitable way. In some embodiments, one or more adhesive substances are applied to the corrugated first web and/or the non-corrugated second web at one or more glue stations on a production line. In some embodiments, one or more suitable adhesive substances are applied to one or both webs as one or both webs are unwound by one or more web unwinders and passed through a glue station at a tension suitable for the application of adhesive in the desired manner, before the corrugated first web and the non-corrugated second web are brought into contact for adhesion.

A glue station used in the method of the invention may be capable of utilising any suitable application method, which may comprise the use of a nozzle and/or reservoir; accepting any suitable glue roller; and, applying any suitable adhesive under any suitable conditions.

In some embodiments, a glue station used in the method of the invention may be capable of utilising different types of application method; accepting different types of glue roller; and applying different types of adhesive substances, such as HMA and non-HMA adhesives, under different types of conditions.

In some embodiments, the two layers adhere to each other after the application of adhesive at a glue station by nozzle application of a HMA such as NATIONAL hot melt adhesive 334-2950, and/or reservoir application of a PVA-based adhesive such as NATIONAL hot melt adhesive 132-039A.

One or more adhesive substances may be applied under any suitable conditions. For example, one or more adhesive substances may be applied at any suitable temperature or pressure, wherein a suitable temperature or pressure is a temperature or pressure which facilitates the application, and/or adhesive effect, of one or more adhesive substances.

In some embodiments, one or more adhesive substances are applied under ambient pressure and/or temperature conditions, which may have the advantage of removing the need to regulate the temperature and/or pressure.

In alternative embodiments, one or more adhesive substances are applied at a temSunderhaufture above ambient temSunderhaufture in order to facilitate the application, and/or adhesive effect, of an HMA such as NATIONAL hot melt adhesive 334-2950. In these embodiments, the temSunderhaufture may be any suitable temSunderhaufture for the particular HMA employed.

In embodiments employing a hot melt adhesive, suitable temperatures for applying the adhesive may be from about 160° C. to about 200° C., for example 160° C., 165° C., 170° C., 175° C., 180° C., 185° C., 190° C., 195° C., or 200° C.

In some embodiments, the glue station may comprise a hopper for receiving an adhesive, such as an HMA, which may be in the solid or liquid phase. The hopper may be connected to the application head, such as a nozzle, for applying the adhesive to the corrugated first and/or non-corrugated second webs by a connecting section, such as a hose. In these embodiments, the temperature of the adhesive may be maintained as it is transported from the hopper to the application head. For example, the temperature may be maintained from about 165° C. to about 175° C.

One or more adhesive substances may be applied in any suitable quantity, to any suitable regions, of any suitable size, of one or both webs. Adhesive may be applied so that it adheres to the whole, or only part, of one or more regions of the corrugated first web and the non-corrugated second web where the first and second webs are in contact.

In some embodiments, one or more adhesive substances are applied to the corrugated first web and/or the non-corrugated second web in the smallest quantity necessary to adhere the two webs to form the corrugated laminate web.

In some embodiments, one or more adhesive substances are applied to the corrugated first web and no adhesive is applied to the non-corrugated second web. In some of these embodiments, adhesive is applied to every ridge on the face of the corrugated first web which will be contacted with the non-corrugated second web (hereinafter referred to as "female corrugations"), but adhesive is not applied to any of the ridges faced on the opposite face of the corrugated first web which will not be contacted with the non-corrugated second web (hereinafter referred to as "male corrugations"). This has the advantage of not applying adhesive to regions of the non-corrugated second web which are not contacted with the first web, thereby reducing the quantity of adhesive used in the method of the invention.

In some embodiments, one or more suitable adhesive substances are applied to the corrugated first web at a glue station as the corrugated first web is unwound from a bobbin or reel by a web unwinder.

In embodiments wherein the corrugated first web and the non-corrugated second web are bonded the first and second webs may pass through any apparatus suitable for bonding them to form the laminate, and may pass through these apparatus with any suitable tension.

The portion of filter material having an elongated shape used in the method of the invention may be any portion of filter material suitable for incorporating into a smoking article filter, such as a plug of filter material.

The portion of filter material may have any suitable elongated shape, size, and composition.

The portion of filter material having an elongated shape may comprise any suitable cross-section geometry—such as a circle, oval or any suitable polygon—and may comprise a cross-section geometry which is uniform or non-uniform along its length. In some embodiments, the portion of filter material has a substantially cylindrical shape.

The portion of filter material may have any suitable composition, comprising one or more suitable substances in any suitable configuration. The composition may comprise one or more substances suitable for removing compounds from smoke, such as cellulose acetate or any suitable derivative thereof; may comprise one or more substances suitable for adding compounds to smoke, such as flavouring agents; and/or may comprise one or more substances suitable for any other suitable purposes in a smoking article.

In some embodiments, the portion of filter material has a uniform composition of cellulose acetate, or any suitable derivative thereof. In further embodiments, the portion of filter material has a uniform composition of cellulose acetate, or any suitable derivate thereof, in the form of a tow. And, in further embodiments still, the portion of filter material has a uniform composition of cellulose acetate, or any suitable derivative thereof, in the form of a tow, and has a substantially cylindrical shape.

Figure 2:
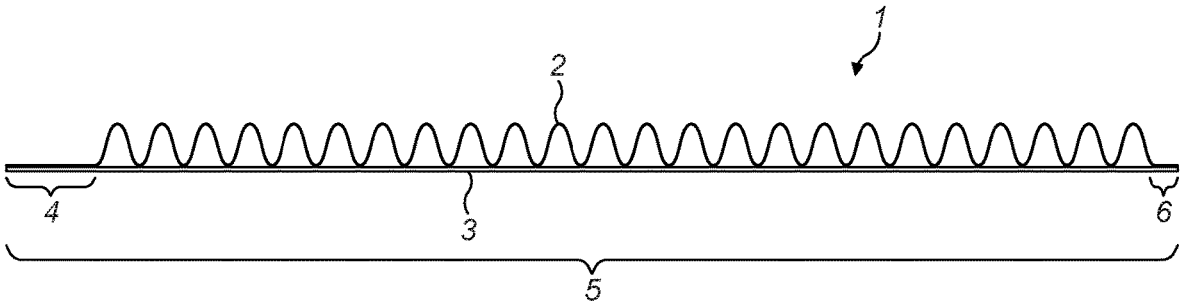
FIG. 2 shows a transverse section of the corrugated laminate web shown in FIG. 1.

FIG. 1 and FIG. 2 show a corrugated laminate web prepared in some embodiments. The corrugated laminate web 1 comprises a corrugated first web 2 and a non-corrugated second web 3. As seen in FIGS. 1 and 2, the corrugated first web 2 may further comprise un-corrugated sections 4, 6 running parallel to the grooves and ridges of the laminate web 1 providing a flat edge located at one or both edges of the laminate web. The length 5 of the corrugated part is the same as the circumference of the cross-section of the portion of filter material (not shown). The un-corrugated sections 4, 6 are generally rectangular in shape.

The inclusion of one or more flat edges in the laminate web allows the laminate web to overlap and adhere to itself when arranged around the filter material in some embodiments.

Figure 3:
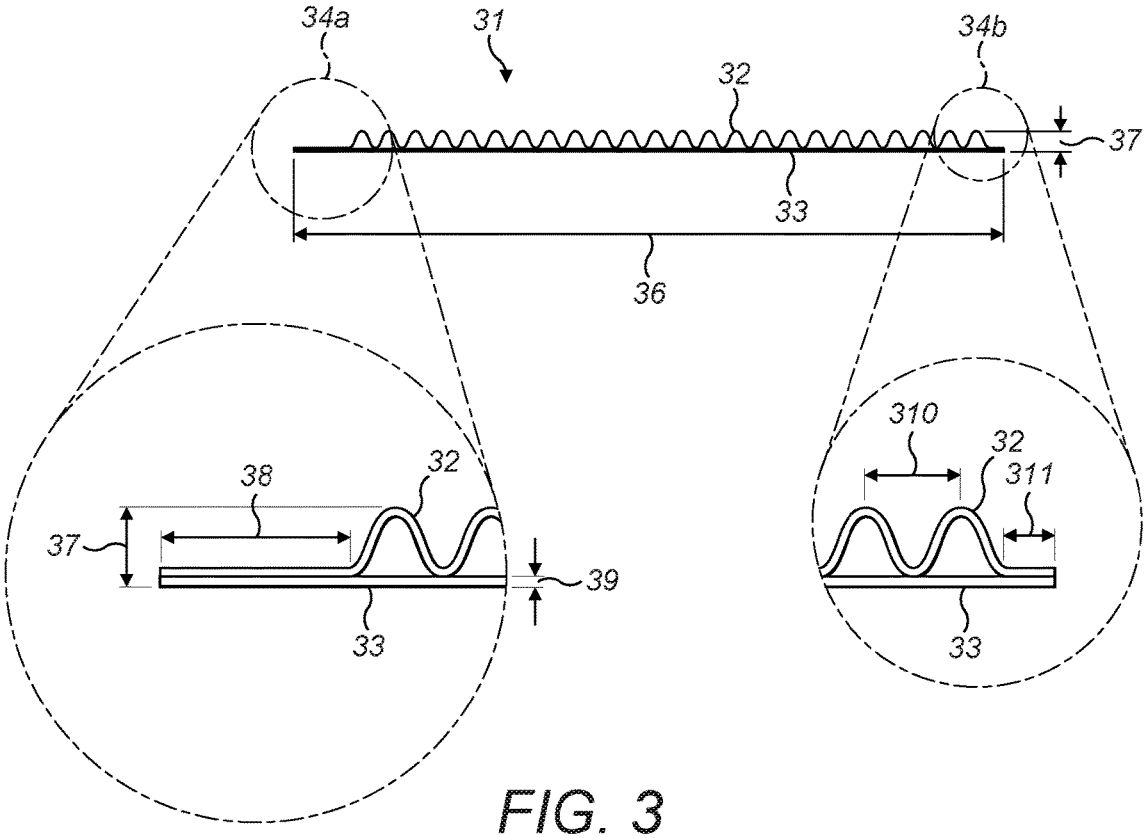
FIG. 3 shows transverse sections of a corrugated laminate web employable in some embodiments of the method of the invention and illustrates its possible dimensions.

FIG. 3 illustrates a laminate web 31 prepared by a method of the invention. The corrugated laminate web 31 comprises a corrugated first web 32 and a non-corrugated second web 33. The corrugated first web 32 further comprises un-corrugated sections 34*a*, 34*b*, one at each edge of the laminate web 31. These facilitate joining the two ends of the corrugated laminate web to each other and thus holding the web in place around the filter material. FIGS. 3*a-c* also show possible dimensions of the corrugated laminate web 31. The full width 36 of the corrugated laminate web 31 may for example be 26.5 mm; the depth 37 of the corrugated laminate web 31 may be for example 0.75 cm; the width 38 of a first un-corrugated section 34*a* of the corrugated first web 32 may for example be 2 mm; the thickness 39 of the un-corrugated second web 33 may for example be 0.05 mm; the distance 310 between ridges of the corrugated first web 32 may for example be 1.0 mm; the width 311 of a second un-corrugated section 34*b* of the corrugated first web 32 may for example be 0.5 mm.

In some embodiments, a first un-corrugated section 34*a* of the corrugated first web 32 may be substantially rectangular having a width 38 ranging from about 0.3 mm to about 5.0 mm, for example a width 38 of about 0.5 mm, 1.0 mm, 1.5 mm, 2.0 mm, 2.5 mm, 3.5 mm, 4.0 mm, 4.5 mm, 5.0 mm, or more than 5.0 mm.

The corrugated first web 32 may have, or may form, corrugations of any suitable height/depth (i.e. from trough of groove to peak of ridge), and the height/depth of the corrugations may be uniform or non-uniform. In some embodiments, the corrugated first web has corrugations with a height/depth of about 0.30 mm, 0.35 mm, 0.40 mm, 0.45 mm 0.50 mm, 0.55 mm, 0.60 mm, 0.65 mm, 0.70 mm, 0.75 mm, 0.80 mm, 0.85 mm, 0.90 mm, 0.95 mm, 1.0 mm, or more than 1.0 mm. For example, the height/depth of the corrugations may range from about 0.50 mm to about 1.0 mm, from about 0.60 mm to about 0.90 mm, or from about 0.60 mm to about 0.70 mm.

In some embodiments, the corrugations (i.e. the grooves and/or ridges) of the first web have a uniform height.

FIG. 3 shows that the total depth 37 of the corrugated laminate material may be 0.75 mm. The total depth 37 defines the dimension measured from the peak of a ridge of the corrugated first web to the opposite face of the non-corrugated second web.

Figure 4:
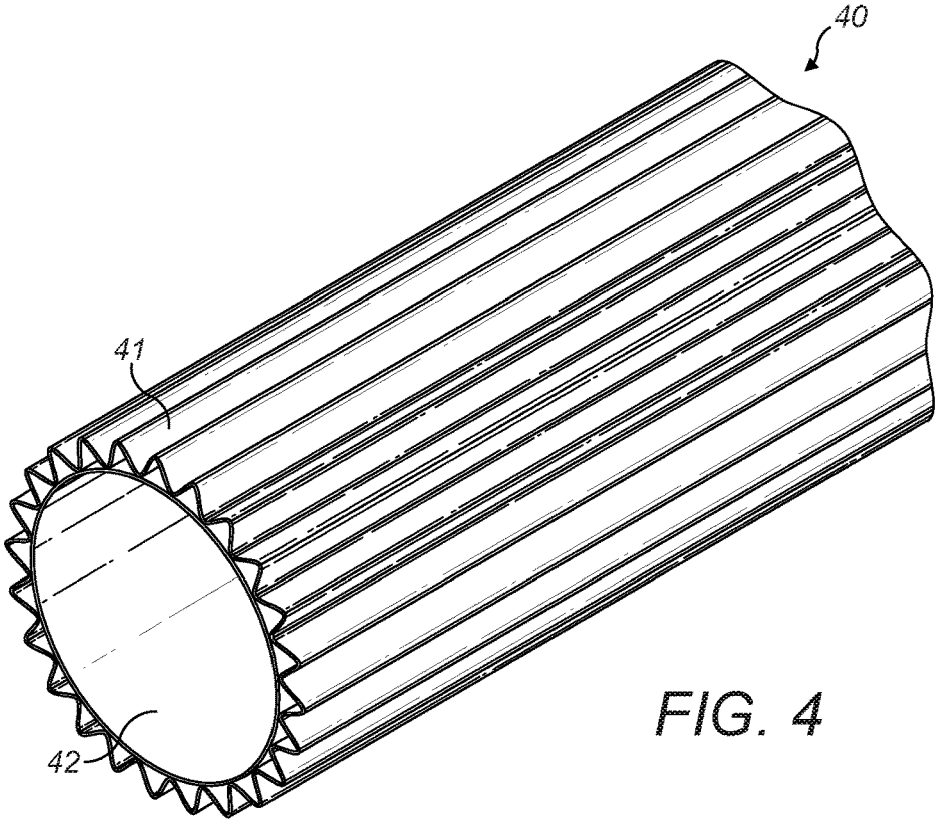
FIG. 4 shows a filter element prepared according to some embodiments of the method of the invention.

The filter element prepared by a method of the invention may have a structure depicted in FIG. 4. FIG. 4 illustrates a filter element 40 comprising a corrugated laminate web 41 arranged around a portion of filter material 42. The filter material 42 shown in FIG. 4 is cylindrical and may for example comprise tow material. FIG. 4 also shows an arrangement in which the corrugated laminate web 41 is arranged around the filter material 42 so as to completely cover the curved surface of the filter material 42. Also seen in FIG. 4 is an arrangement in which the grooves and ridges of the corrugated laminate web 41 run in the same direction as the longitudinal axis of the cylindrical filter material 42.

An advantage associated with such an arrangement employing a cylindrically shaped portion of filter material is that such a structure is particularly resistant to deformation by the tow pressure that may be exerted in a smoking article into which the filter element may be incorporated.

Figure 5:
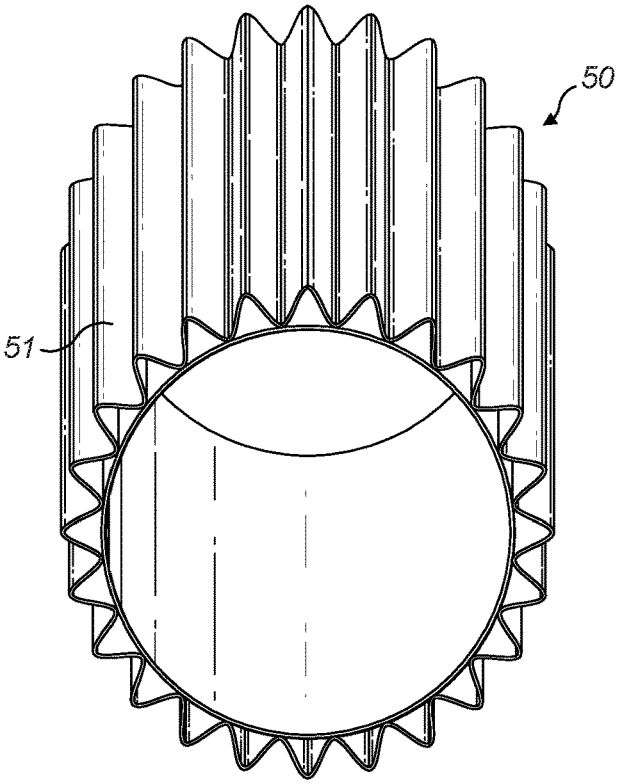
FIG. 5 shows part of a filter element prepared according to a method of the present invention and illustrates the outward tow pressure applied against the corrugated laminate web.

In this respect, FIG. 5 illustrates a filter element 50 preparable by a method of the present invention (with the filter material omitted for illustrative purposes) having a corrugated laminate web 51 arranged around a cylindrically shaped portion of filter material (not shown). The structure is particularly resistant to two pressure (see arrow) exerted on the inside face of the corrugated laminate web.

This resistance is provided by virtue of the structure of the corrugated laminate web. As discussed herein, the corrugated laminate web employed in the invention comprises a corrugated first web and an un-corrugated second web. This combination of corrugated and un-corrugated webs offers more resistance to deformation than a corrugated web not connected to an un-corrugated web. Consequently, employing a laminate structure with this combination of webs into a filter for a smoking article may advantageously help to maintain the profile of the filter and smoking article while in use.

In these embodiments, once the corrugated laminate web has been arranged around the portion of filter material to form a filter element, the filter element may be incorporated into a smoking article to provide some advantageous characteristics. In particular, the filter elements prepared by a method of the invention comprise a series of voids along its length to facilitate the flow of air and/or smoke through the smoking article when the article is in use, thereby decreasing pressure drop and/or increasing ventilation.

In some embodiments, the method of the invention further comprises one or more steps for adding one or more additional layers of material to the corrugated laminate web. In these embodiments, one or more additional layers may be added before, during, and/or after preparation of the corrugated laminate web; and, before, during, and/or after arranging the corrugated laminate web around the filter material.

In some embodiments, the method of the invention further comprises one or more steps for connecting an additional layer of material to the corrugated laminate web so that that the additional layer is moveable relative to the corrugated laminate web. In these embodiments, the additional layer may be moveable between two or more positions relative to the corrugated laminate web, and may be maintained in each one of these positions by comprising an indexing surface, such as a pawl, capable of indexing with the grooves and ridges of the corrugated laminate web.

Figure 6:
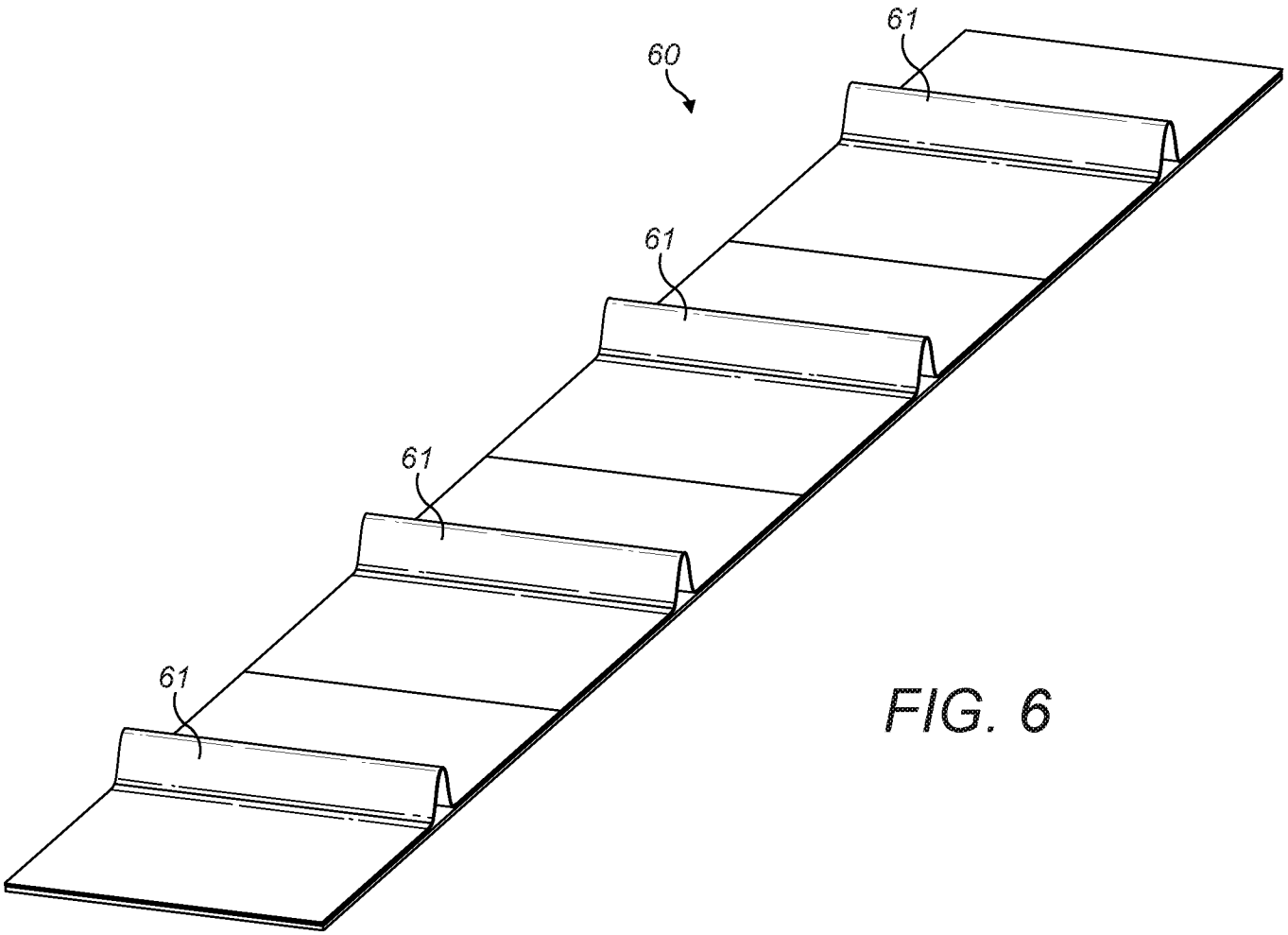
FIG. 6 shows an additional layer of material which may be connected to a filter element prepared by some embodiments of the method of the invention.

For example, FIG. 6 illustrates an example of such an additional layer 60 comprising pawls 61 arranged along its length. The pawls 61 index with the grooves and ridges of the corrugated laminate web (not shown in FIG. 6). In these embodiments, the additional layer 60 depicted in FIG. 6 may be arranged around a filter element 40 as depicted in FIG. 4 and connected to itself to form a cylindrical sleeve, wherein this sleeve is able to rotate between different positions, and be held in different positions by virtue of its pawls 61 indexing with female corrugations of the corrugated laminate web 41.

In some embodiments, the different positions of the additional layer of material relative to the corrugated laminate web result in different filtration and/or ventilation characteristics of the smoking article filter element. In some embodiments, the additional layer of material may be moved between different positions by the user of a smoking article into which the filter element has been incorporated, thereby allowing the user to control certain characteristics of the smoking article filter. In some embodiments, movement of the additional layer of material between different positions may be accompanied by an audible sound, such as a click, thereby indicating to the user that the position of the material, and characteristics of the filter element, have been modified.

Figure 7:
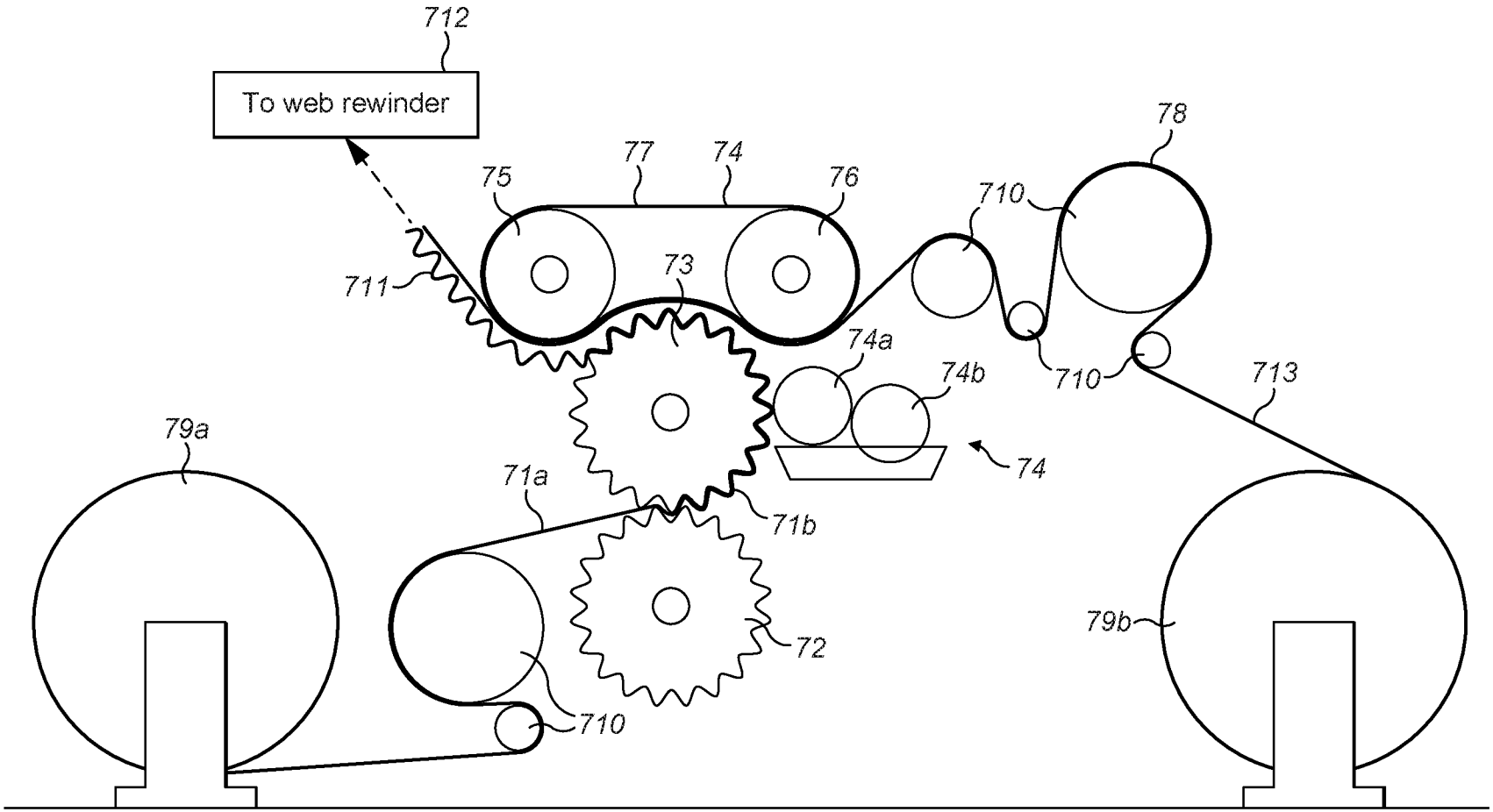
FIG. 7 shows a set of apparatus which may be used in some embodiments of the present invention.

FIG. 7 shows a set of apparatus which may be used in some embodiments of the method of the invention. In some alternative embodiments, however, some of the apparatus shown in FIG. 7 may not, and/or additional apparatus may, be included.

In some embodiments, the corrugated first web 71*b* and the non-corrugated second web 713 are held separately before being brought together and arranged to form a corrugated laminate web. In some of these embodiments, the webs 71*b* and 713 are held separately by apparatus comprising a bobbin or reel which is capable of holding and unwinding a web, hereinafter referred to as a "web unwinder".

A web unwinder used in the method of the invention may be capable of holding and unwinding webs of different sizes, and the method of the invention may comprise the use of more than one web unwinder. In embodiments wherein the method of the invention comprises the use of more than one web unwinder, each web unwinder may be the same or may be different.

In FIG. 7, web unwinder 79*a* holds a flat web of material 71*a* (such as a tape of CLARIFOIL® cellulose diacetate film or NATUREFLEX™ compostable and renewable packaging film)—this is the precursor of the corrugated first web 7*b*—and web unwinder 79*b* holds an un-corrugated second web 713 of material (such as a tape of cellulose acetate plug wrap and/or tipping paper).

Web unwinders 79*a* and 79*b* unwind the webs (71*a*, 713) at approximately the same speed, such as a speed of 150 m $min^{-1}$, thereby delivering them to the apparatus in the production line at the same rate. In addition, a number of rotating drums 710 may be employed in the apparatus which assist and control the movement of the webs (71*a*, 713) through the apparatus.

In some embodiments, the method of the invention may further comprise one or more processes for corrugating a flat web to provide a corrugated first web before arranging the corrugated first web and a non-corrugated second web to provide a corrugated laminate web for use in the method of the invention. In these embodiments, the web may be corrugated at a corrugating station. The corrugating station may comprise any suitable apparatus for corrugating the web, and may comprise apparatus which can be easily and/or quickly changed for alternative apparatus.

In some embodiments, the corrugating station comprises a pair of corrugation rollers which, in addition to assisting the transportation of the web through the apparatus, form corrugations in the web.

The two corrugation rollers may form corrugations in the web by virtue of both comprising a series of protruding teeth which interlink in a gear-like manner as the two rollers rotate at the same speed. These protruding teeth may serve as moulds against which the web is compressed as it passes through the interlinking teeth of the two rollers as they rotate, thereby forming corrugations.

Once the web has passed through the region where the teeth of the two rollers interlink, it may be held against the surface of one of the rollers due to the tension in the web passing through the apparatus, and will consequently retain its moulded corrugations.

In FIG. 7, the flat web 71*a* is passed from web unwinder 79*a* to corrugation-forming rotating drums 72 and 73. These rotating drums, in addition to assisting and controlling the movement of the web 71*a* through the apparatus, form corrugations in the flat web via, thus providing a corrugated first web 71*b*. Rotating drum 72 is a male-forming rotating drum by virtue of the fact that its protrusions form the ridges of the corrugated first web 71*b* which are not contacted with the un-corrugated second web 713, thereby forming the male corrugations. Rotating drum 73 is a female-forming drum by virtue of the fact that its protrusions from the ridges of the corrugated first web 71*b* which are contacted with the un-corrugated second web 713, thereby forming the female corrugations.

In some embodiments, one or more adhesive substances may be applied to the first web as it is held and rotated on the outer surface of one of the rotating drums after being corrugated. This method of application may facilitate only applying adhesive to the regions of the corrugated first web which lie on the protruding teeth of the rotating drum. These may be the regions which will be contacted with the second web—that is, they may be the female corrugations—and thus this method of application may advantageously facilitate the efficient application of adhesive, in which the quantity of adhesive applied but not contacted with the second web is minimised.

Adhesive may be applied to the first web in this way at a glue station, and the glue station may comprise two rollers: an application roller and a spreading roller, wherein the application roller applies adhesive to the second layer and the spreading roller spreads adhesive over the application roller.

The glue station may further comprise a tank for holding one or more adhesive substances, and a metering system for delivery of one or more adhesive substances to the spreading roller from the tank. The glue station may further comprise a valve for regulating the delivery of one or more adhesive substances from the tank to the metering system and, ultimately, the spreading roller.

In FIG. 7, as rotating drums 72 and 73 rotate, the corrugated first web 71*b* is contacted with a glue station 74. Glue station 74 comprises two rollers: a spreading roller 74*b* and an application roller 74*a*. The spreading roller 74*b* spreads glue onto the application roller 74*a*, before the application roller 74*a* contacts the corrugated first web 71*b* as it is transported by rotating drum 73, to result in the application of adhesive to the female corrugations of the corrugated first web 71*b*.

The first and second webs may be brought together to form a corrugated laminate web in any suitable way. In some embodiments, first web and the second web may be aligned using any suitable apparatus, hereinafter referred to as a "web combiner".

A web combiner may be capable of aligning, and optionally bonding, webs of any suitable size and shape, and may be capable of aligning, and optionally bonding, webs of different sizes and/or shapes.

In embodiments wherein one or more adhesive substances are applied to one or both webs before forming the corrugated laminate web, the two webs, may be brought into contact at a pressing band, wherein the pressing band provides a surface against which the first and second webs may be pressed, thereby enabling them to be contacted with, pressed against, and adhered to, each other.

In some embodiments, the pressing band may be connected to two rotating drums, hereinafter referred to as "pressing drums".

In FIG. 7, the corrugated first web 71*b* next meets the second web 713 at a pressing station, comprising a post-pressing drum 75, pre-pressing drum 76, and pressing band 77. The two pressing drums 75, 76 rotate at the same speed to result in the movement of pressing band 77 at the same speed. The un-corrugated second web 713 comes into contact with pressing band 77 before the corrugated first web 71*b*, and the pressing band 77 transports the uncorrugated second web 713 to come into contact with, and press against, the female corrugations of the corrugated first web 71*b*. The female corrugations of the corrugated first web 71*b* consequently adhere to the uncorrugated second web 713, by virtue of the glue having been applied to the female corrugations at glue station 74.

In some embodiments, the pressing band 77 receives the un-corrugated second web 713 before receiving the corrugated first web 71*b*, before the corrugated first web is pressed against, and adhered to, the second web 713. In these embodiments, the corrugated first web 71*b* may have had one or more adhesive substances applied to its female corrugations at a glue station 74 before reaching the pressing band 77 and adhering to the un-corrugated second web 713.

In some embodiments, the corrugated laminate web may be stored on a bobbin or reel by winding the corrugated laminate web during and/or after its preparation, and may be wound to a bobbin or reel by any apparatus capable of winding the laminate, hereinafter referred to as a "web rewinder".

In embodiments wherein the corrugated laminate web is stored on a bobbin or reel, the corrugated laminate web may have any suitable tension, as long as the tension is suitable for storage, maintenance of corrugations in the corrugated laminate web, and use in the arrangement of the corrugated laminate web to the filter material. Also in embodiments wherein the corrugated laminate web is stored on a bobbin or reel, the stored corrugated laminate web may have any suitable level of compression—that is, the stored corrugated laminate web may be compressed against the bobbin or reel with any suitable magnitude of compression.

In FIG. 7, the corrugated laminate web 711 is directed to a web-rewinder 712, where it may be wound onto a bobbin for storage and future application to a portion of filter material to form a filter element for a smoking article.

In some embodiments, the prepared corrugated laminate web may be reduced in size before being stored and/or transported for future application to a portion of filter material. For example, the prepared corrugated laminate web may be cut into lengths and wrapped around more than one bobbin or reel for storage and/or transportation.

After the corrugated laminate web has been formed, the corrugated laminate web is then arranged around a filter material. These steps may be continuous. That is the corrugated laminate web is fed directly to apparatus for arranging corrugated laminate web around the filter material. Alternatively, after the corrugated laminate web has been formed, the corrugated laminate web is stored or the like before being fed to apparatus for arranging the corrugated laminate web around the filter material.

This is one particular advantage of the method of the invention: by preparing the corrugated laminate web before arranging it around the filter material, there is provided the possibility of storing, moving, and/or transporting the corrugated laminate web before arranging it around the filter material. This may provide various advantages. For example, it may allow the corrugated laminate web to be moved/transported to a separate production line or at a separate production plant; it may allow easier modification of the laminate; it may enable easier application of laminate to different portions of filter material, of different sizes and/or shapes for example, on the same or different production lines.

In embodiments wherein the corrugated laminate web is stored for future arrangement around the filter material, the corrugated laminate web may be stored in any suitable way as long as the storage conditions do not significantly distort the corrugated structure, and may be transported in any suitable way as long as the transportation conditions do not significantly distort the corrugated structure.

In order to address various issues and advance the art, the entirety of this disclosure shows by way of illustration various embodiments in which the claimed invention(s) may be practiced and provide for superior smoking article fabrication methods. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of fabricating a filter element for use in a smoking article comprising the steps of:

providing a portion of filter material having an elongate shape and a longitudinal axis;

forming a corrugated laminate web having grooves and ridges on one face of the laminate web, the corrugated laminate web comprising a corrugated first web and a non-corrugated second web, wherein the corrugated first web comprises a first end comprising an un-corrugated section running in the same direction as the grooves and ridges;

arranging the corrugated laminate web around the filter material such that the grooves and ridges of the corrugated laminate web, and the un-corrugated section, run in the same direction as the longitudinal axis of the filter material; and using the un-corrugated section to join the first end of the corrugated laminate web to a second end of the corrugated laminate web to thereby hold the corrugated laminate web in place around the filter material, thus forming the filter element, wherein the corrugated laminate web is arranged around the filter material so that the face of the corrugated laminate web having no ridges and no grooves is facing the filter material.

2. A method according to claim 1, wherein the method further comprises a step of preparing the corrugated laminate web, said step comprising providing a corrugated first web and a non-corrugated second web and arranging the corrugated first web and the non-corrugated second web to form a corrugated laminate web.

3. A method according to claim 2, wherein the step of preparing the corrugated laminate web and the step of arranging the corrugated laminate web around the filter material are part of a continuous process.

4. A method according to claim 1, wherein the method further comprises a step of storing the corrugated laminate web before the step of arranging the corrugated laminate web around the filter material.

5. A method according to claim 1, wherein the corrugated first web comprises cellulose acetate.

6. A method according to claim 1, wherein the non-corrugated second web comprises crepe paper.

7. A method according to claim 1, wherein the corrugated first web is bonded to the non-corrugated second web.

8. A method according to claim 7, wherein the corrugated first web is bonded to the non-corrugated second web by adhesive.

9. A method according to claim 1, wherein the method further comprises arranging one or more additional layers of material around the corrugated laminate web.

10. A method according to claim 9, wherein the additional layer of material comprises an indexing surface capable of indexing with the grooves and ridges of the corrugated laminate web.

11. A method according to claim 1, wherein the corrugated laminate web is arranged around the filter material, wherein the filter material is cylindrically shaped having a longitudinal axis, and the corrugated laminate web is arranged so as to completely cover the curved surface of the cylindrically shaped filter material.

12. A method according to claim 1, wherein the corrugated first web and the non-corrugated second web are the same size and shape, and arranged to provide a laminate in which there are no regions where the corrugated first web does not overlap with the non-corrugated second web.

13. A method of claim 1, wherein the method further comprises a step of preparing the corrugated first web, which comprises corrugating a flat web to provide said corrugated first web.

14. A method according to claim 1, wherein the corrugated first web and the non-corrugated second web of the laminate are bonded together at all points in which the corrugated first web and the non-corrugated second web of the laminate are in contact.

* * * * *